US006558301B1

(12) United States Patent
Jackson

(10) Patent No.: US 6,558,301 B1
(45) Date of Patent: May 6, 2003

(54) EXERCISE APPARATUS

(76) Inventor: Michael L. Jackson, 9540 Pacific View, Las Vegas, NV (US) 89117

( * ) Notice: Subject to any disclaimer, the term of this patent is extended or adjusted under 35 U.S.C. 154(b) by 0 days.

(21) Appl. No.: 09/492,504

(22) Filed: Jan. 27, 2000

(51) Int. Cl.[7] ..... A63B 21/04
(52) U.S. Cl. ..... 482/129; 482/121; 482/123
(58) Field of Search ..... 482/121–130, 482/142, 148

(56) References Cited

U.S. PATENT DOCUMENTS

| | | | | |
|---|---|---|---|---|
| 3,664,666 | A | 5/1972 | Lloyd | |
| 3,893,667 | A | 7/1975 | Snyder, Jr. et al. | |
| 4,198,044 | A | 4/1980 | Holappa | |
| 4,913,423 | A | 4/1990 | Farran et al. | |
| 5,050,861 | A | 9/1991 | Thomas et al. | |
| 5,072,934 | A | 12/1991 | Blanes | |
| 5,090,694 | A | 2/1992 | Pauls et al. | |
| 5,118,095 | A | 6/1992 | Flor | |
| D330,057 | S | 10/1992 | Saunders et al. | |
| D330,234 | S | 10/1992 | Saunders et al. | |
| 5,154,678 | A | * 10/1992 | Adamezyk et al. | 482/52 |
| D337,362 | S | 7/1993 | Goldstein et al. | |
| 5,232,426 | A | 8/1993 | Van Straaten | |
| D339,179 | S | 9/1993 | Wilkinson | |
| 5,261,864 | A | * 11/1993 | Fitzpatrick | 482/52 |
| 5,277,675 | A | 1/1994 | Shifferaw | |
| 5,290,210 | A | * 3/1994 | Hand et al. | 482/51 |
| 5,320,591 | A | 6/1994 | Harmon et al. | |
| 5,354,247 | A | * 10/1994 | Wilkinson | 482/52 |
| D353,419 | S | 12/1994 | Sprague | |
| D353,636 | S | 12/1994 | Le Roux | |
| 5,441,466 | A | 8/1995 | Piaget et al. | |
| 5,505,681 | A | 4/1996 | Bruggemann | |
| 5,512,026 | A | 4/1996 | Wilkinson | |
| 5,529,562 | A | 6/1996 | Glaser | |
| 5,575,742 | A | * 11/1996 | Wu | 482/92 |
| 5,584,779 | A | 12/1996 | Knecht et al. | |
| 5,591,105 | A | 1/1997 | Dalebout et al. | |
| 5,593,370 | A | 1/1997 | Meldeau | |
| 5,599,258 | A | 2/1997 | Stone et al. | |
| 5,645,512 | A | 7/1997 | Yu | |
| 5,658,227 | A | 8/1997 | Stearns | |
| 5,669,864 | A | 9/1997 | Brister | |
| 5,683,331 | A | 11/1997 | Dalebout | |
| 5,711,745 | A | 1/1998 | Yang | |
| 5,713,821 | A | 2/1998 | Nissen | |
| 5,718,656 | A | 2/1998 | Byrd et al. | |
| 5,810,697 | A | 9/1998 | Joiner | |
| 5,813,947 | A | 9/1998 | Densmore | |
| 5,830,111 | A | 11/1998 | Johnston | |
| 5,842,955 | A | 12/1998 | Wilkinson | |
| 5,860,894 | A | 1/1999 | Dalebout et al. | |
| 5,860,895 | A | 1/1999 | Lee | |
| 5,860,898 | A | 1/1999 | Ellis | |
| 5,865,713 | A | 2/1999 | Hsu | |
| 5,888,175 | A | 3/1999 | Chang | |
| 5,895,342 | A | 4/1999 | Solland | |
| 5,967,955 | A | 10/1999 | Westfall et al. | |
| 6,245,001 | B1 * | 6/2001 | Siaperas | 482/142 |

* cited by examiner

*Primary Examiner*—Nicholas D. Lucchesi
*Assistant Examiner*—Lori Baker Amerson
(74) *Attorney, Agent, or Firm*—Weide & Miller, Ltd.

(57) ABSTRACT

An exercise apparatus, a method of using the apparatus, and a method of exercising are disclosed. In one or more embodiments, the exercise apparatus comprises an exercise platform comprising a base and a lid, the platform defining an interior space accessible by moving the lid from a closed to an open position with respect to the base, at least one handle associated with the platform for use by a user in moving the exercise apparatus, at least one wheel movably mounted to the base and permitting the platform to be rolled along a surface, at least one riser for use in supporting the platform upon a surface to increase a height thereof and sized to fit within the interior space when not in use, at least one resistive element for selective attachment to the platform for use in an exercise by a user, at least one mount associated with the platform to which the at least one resistive element may be attached, and at least one hand/foot peg for use with the platform.

19 Claims, 3 Drawing Sheets

54
20
56
58
26
50
48
76
76
104
110
106
108
110
30
88
86
92
96
94
90
36
80
98
102
100
99
28
22
74
42
74
52
46
44
30
78
72
34
86
102
88
100
72
38
94
98
68
52
40
70
24
96
28
92
82
84
32
82
84
32

EXERCISE APPARATUS

FIELD OF THE INVENTION

The present invention relates to an exercise apparatus.

BACKGROUND OF THE INVENTION

In recent years, the number of individuals who have undertaken exercise regimens has grown tremendously. Each person has their own desires when it comes to when and where to exercise, and the type and number of exercises in which they wish to engage. Gyms provide large numbers of individuals with a wide range of exercise devices. Some people, however, wish to exercise at home or the office, by personal preference or constraints such as time or location. Individuals may have a limited budget and space for exercise equipment at home. As described below, current exercise equipment does not meet the differing goals and preferences of users.

Currently, a large variety of exercise equipment is available. This equipment ranges from simple steps, mats and free weights, to large and complex machinery that may be computer controlled, such as treadmills, rowing and stepping machines. Most individuals are limited in the number and type of exercise devices they may own, generally as a result of the cost of such equipment and the space necessary to store and use the equipment. Even gyms must be conscious of the space required by each piece of equipment or the number of devices which the gym may provide to its users may be unduly limiting. Thus, it is a desire to provide an exercise apparatus which may be conveniently stored and which is affordable to the home/office user.

Individuals commonly employ an exercise regimen where they work out at home or the gym one or more times per week. These individuals generally find it desirable to maintain their regimen when traveling, such as when on a business trip or vacation. Further, as noted above, some individuals do not wish to work out in a gym on all occasions or ever, but prefer to work out at home or work. For these reasons, it is desirable to provide exercise equipment which is portable and easy to store.

In addition to the foregoing, it is important to note that most individuals wish to engage in multiple exercises. For example, large numbers of individuals enjoy "step" exercises. These exercises involve stepping on and off a raised platform. These exercises are known for their cardiovascular benefits and work-out of the legs. In addition, the same individuals may wish to engage in strength and flexibility training involving other portions of the body, such as the arms, chest and shoulders. For example, bicep curls, rowing, overhead presses and similar exercises are all well known for exercising various specific portions of the body.

Present exercise equipment is deficient in addressing the above-stated problems and preferences. For example, large multi-station weight machines provide a user with the opportunity to perform a large number of exercises. On the other hand, these machines are not transportable, and are generally large and expensive. Simple "steps" are available (including those which may be raised and lowered). These devices are easy to transport and relatively inexpensive, but afford the user very few exercises.

As a result of the above-stated problems and desires, there is a need for an exercise device which is both compact and portable. In addition, however, it is desirable for the device to permit a wide range of exercises.

SUMMARY OF THE INVENTION

The present invention comprises an exercise apparatus, one or more methods of using the apparatus, and one or more methods of exercising with the apparatus.

In one or more embodiments, the exercise apparatus comprises an exercise platform comprising a base and a lid, the platform defining an interior space accessible by moving the lid from a closed to an open position with respect to the base, at least one handle associated with the platform for use by a user in moving the exercise apparatus, at least one wheel movably mounted to the base and permitting the platform to be rolled along a surface, at least one riser for use in supporting the platform upon a surface to increase a height thereof and sized to fit within the interior space when not in use, at least one resistive element for selective attachment to the platform for use in an exercise by a user, at least one mount associated with the platform to which the at least one resistive element may be attached, and at least one hand/foot peg for use with the platform.

In one or more embodiments, the mounts comprise aligned slots in the walls and lid and a pin extending across the portion of the slot in the wall. The resistive elements may comprise elastic elements having a hook at one end for coupling to the pin of a mount.

In one or more embodiments, the lid is hingedly mounted to the platform. One or more latches are provided for maintaining the lid in a closed position when a user is exercising.

One or more embodiments of the invention comprise a method of using the exercise apparatus. These methods include methods of transporting and arranging the apparatus for use.

One or more embodiments of the invention comprise methods of exercising using the apparatus. These methods include using the apparatus as an exercise platform/step and using the hand/foot pegs and resistive element(s) coupled to the platform in a variety of exercises.

Further objects, features, and advantages of the present invention over the prior art will become apparent from the detailed description of the drawings which follows, when considered with the attached figures.

DETAILED DESCRIPTION OF THE INVENTION

The present invention is an exercise apparatus. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
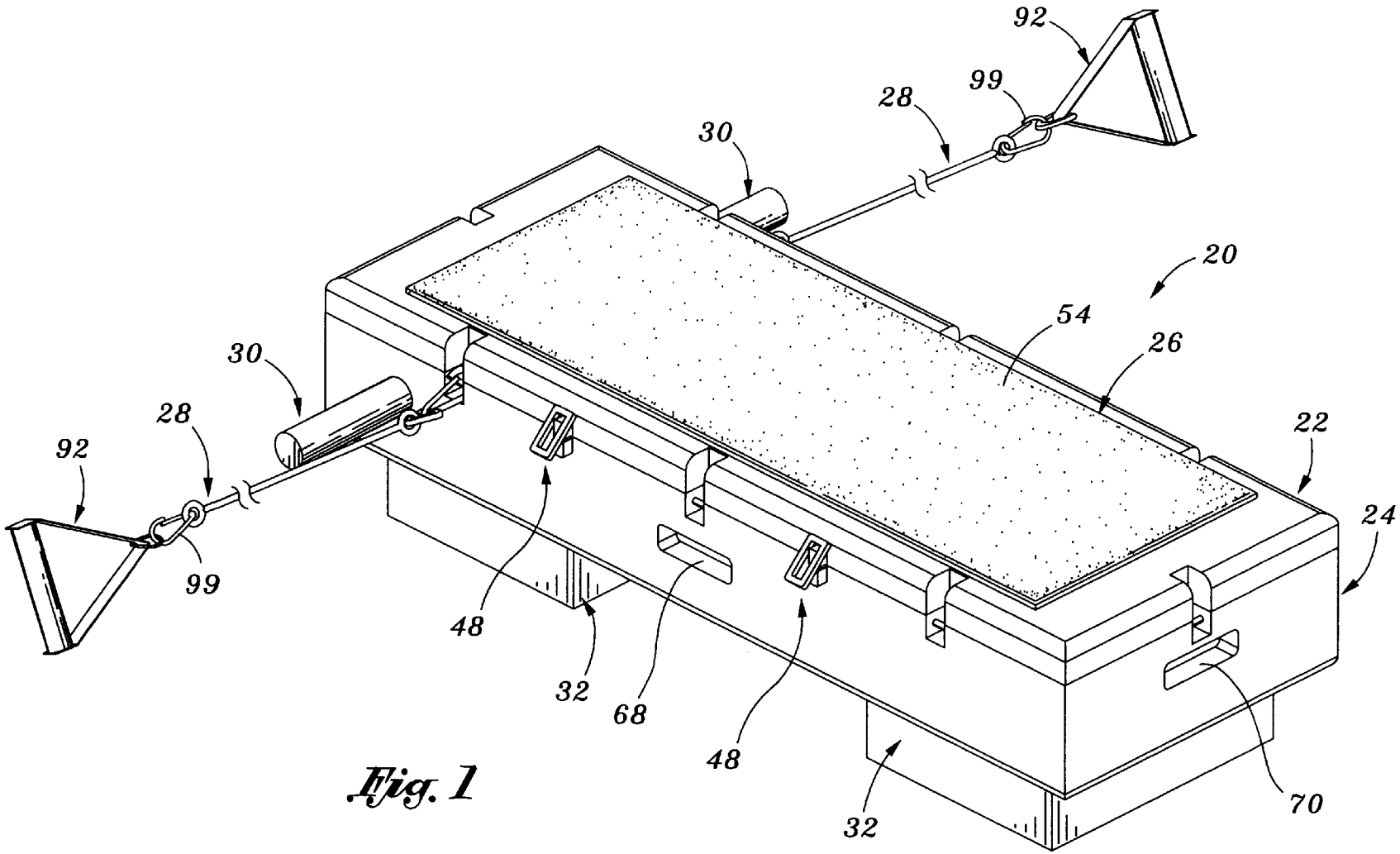
FIG. 1 is a top perspective view of an embodiment of the exercise apparatus in accordance with the present invention.

Referring to FIG. 1, an exercise apparatus 20 of the present invention will be described generally. As illustrated, the exercise apparatus 20 comprises an exercise platform 22. The platform 22 generally has the form of a box having a base 24 and a lid 26, and defines an open interior (see FIG. 3). The exercise platform 22 is arranged to permit a wide range of exercises both alone and with a variety of accessories. As illustrated, such accessories may include one or more resistive elements 28, one or more hand/foot pegs 30, and one or more risers 32.

Figure 2:
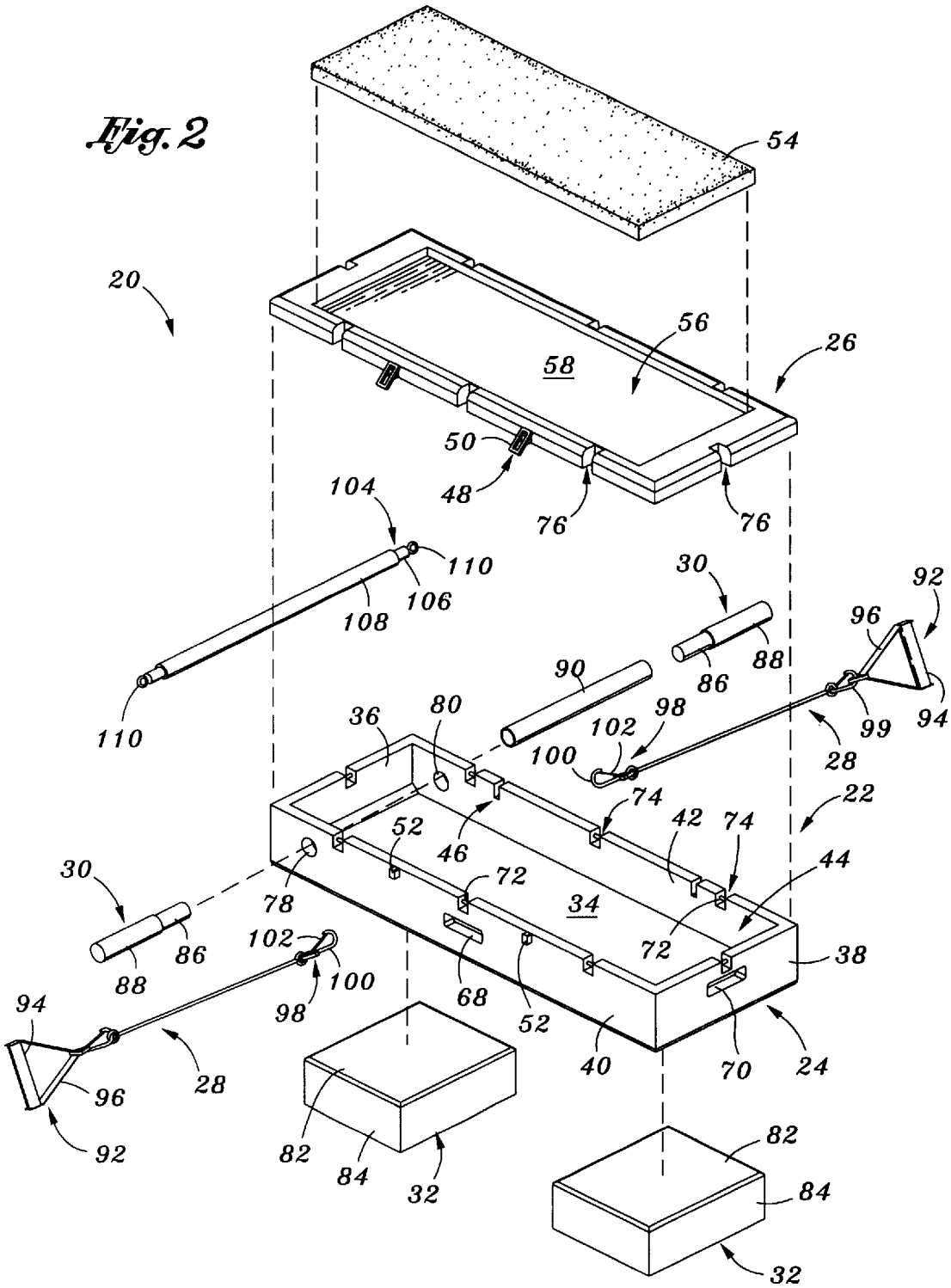
FIG. 2 is an exploded view of the exercise apparatus illustrated in FIG. 1.

The invention will now be described in more detail with reference to FIG. 2. As illustrated therein, the base 24 is generally rectangular in shape. The base 24 has a generally flat bottom surface 34. First, second, third and fourth walls 36,38,40,42 extend upwardly from the bottom surface 34. In the arrangement where the base 24 is generally rectangular in shape, one pair of opposing walls or ends (as illustrated, the first and second walls 36,38) are shorter than the other pair of opposing walls or sides (as illustrated, the third and fourth walls 40,42). In one or more embodiments, the platform 22 is about 40 inches long from end to end (i.e. wall 36 to wall 38) and about 15 inches wide from side to side (i.e. wall 40 to wall 42), and about 4 inches deep as measured from the top of the walls to the top or inside of the bottom surface 34. Of course, the size and shape of the platform 22 may vary from that described.

The lid 26 is arranged to mate with the walls 36,38,40,42 and generally cooperate with the base 24 to form an interior space 44. As illustrated, the lid 26 has the same general shape as the base 24, in this embodiment, rectangular.

The base 24 and lid 26 may be constructed from a wide variety of materials, such as plastic or wood. It will be appreciated that while the walls 36,38,40,42 are described independently for reference, the walls may comprise a single structural element, such as when the base 24 is molded.

Figure 4:
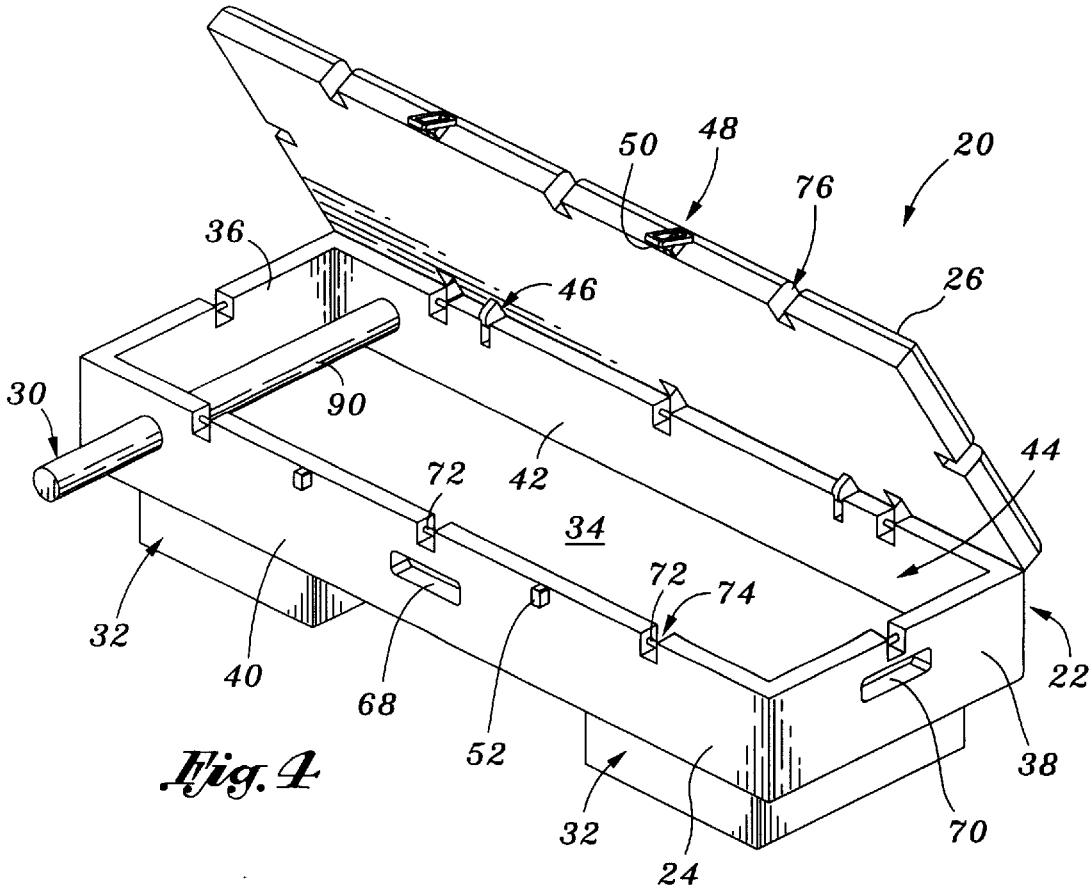
FIG. 4 is a bottom perspective view the exercise apparatus illustrated in FIG. 1.

In one or more embodiments, means are provided for selectively moving the lid 26 with respect to the base 24 so as to open or close the platform 22 and provide access to the interior space 44. Preferably, this means comprises a pair of hinges 46 (see also FIG. 4). Each hinge 46 is attached to the lid 26 and the base 24. As described in more detail below, the hinges 46 permit rotation of the lid 26 about an axis extending parallel to the fourth wall 42 of the base 24. In a first open or raised position of the lid 26, access is permitted to the interior 44 of the platform 22. In a second closed or lowered position of the lid 26, the interior space 44 is enclosed. As illustrated, the hinges 46 are spaced apart along the fourth wall 42.

Preferably, means are provided for, at one or more times, retaining the lid 26 in its second, closed or lowered position. In one or more embodiments, this means comprises a pair of latches 48. Each latch 48 comprises a moveable catch 50 connected to the lid 26 and a post 52 connected to or extending from the base 24.

Those of skill in the art will appreciate that a variety of other means may be provided for associating the lid 26 with the base 24. For example, the lid 26 may be connected to the base 24 by providing a rod connected to the lid which engages one or more sleeves, permitting rotation of the rod with respect to the sleeves. If constructed of plastic, the lid 26 may be connected to the base 24 by a thin web of material which is sufficiently flexible to permit the lid 26 to be raised and lowered with respect to the base 24.

The lid 26 need not be rotatably connected to the base 24. For example, the lid 26 may be arranged to rest upon the base 24, such as by including a slot in a bottom surface thereof into which a top portion of each of the walls 36,38,40,42 may extend when the lid 26 is placed thereon. In such an arrangement, the lid 26 may be removed by lifting it off of the base 24.

Those of skill in the art will also appreciate the numerous means by which the lid 26 may be secured to the base 24. Instead of, or in addition to the latches 48, hooks, straps with hook and loop fastener material, or snaps or the like may be arranged to selectively engage the base 24 to maintain the lid 26 secured thereto. The lid 26 may include on its bottom surface a slot for accepting the base 24 or have any outwardly extending section for positioning within the walls 36,38,40,42, whereby the lid 26 may be press-fit into engagement with the base 24.

In one or more embodiments, a pad 54 is provided on a top surface 56 of the lid 26. The pad 54 may be of a variety of types, such as an element having durable outer polymer surface with a foam interior. In one or more embodiments, the top surface 56 of the lid 26 has a recessed or inset area 58 for accepting a portion of the pad 54. Preferably, the pad 54 covers a substantial portion of the top surface 56 of the lid 26. As illustrated, the pad 54 is generally rectangular, covering all but a narrow perimeter section of the lid 26. The pad 54 may have a variety of thicknesses and may be connected to the lid 26 in a variety of fashions. In one or more embodiments, the pad 54 may be selectively removable from the lid 26 for washing, replacement or the like.

Figure 3:
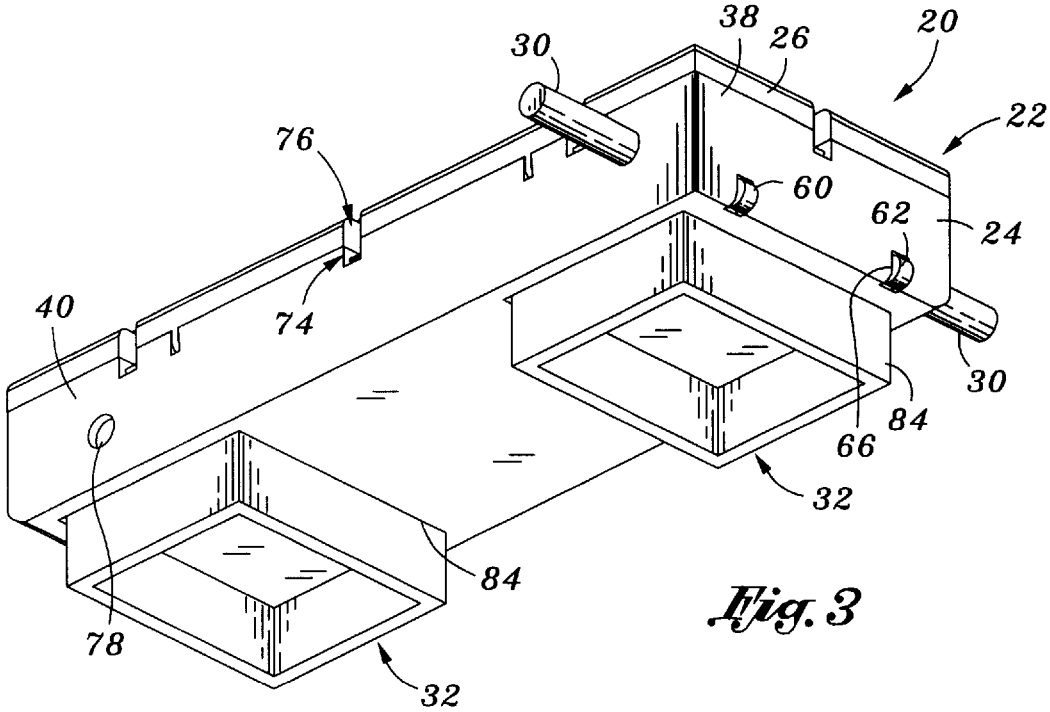
FIG. 3 is a perspective view of the exercise apparatus as in FIG. 1 with a lid thereof in an open position.

In one or more embodiments, means are provided for rollably supporting at least a portion of the platform 22. Referring to FIG. 3, in a preferred embodiment, the means comprises first and second wheels 60,62. As illustrated, the wheels 60,62 are positioned near the intersection of the first wall 36 and the bottom surface 34 of the base 24. In order to reduce the distance by which the wheels 60,62 extend from the base 24, and to provide a convenient mounting, each wheel 60,62 is inset into a slot 66 extending into the bottom surface 34 and first wall 36. The wheels 60,62 are spaced apart and located near the outer ends of the wall 36 for stability purposes.

In one or more embodiments, each wheel 60,62 is mounted on an axle (not shown) which is, in turn, mounted to the base 24. As will be appreciated, the wheels 60,62 may be mounted for rotation with respect to their axles and the axles securely connected to the base 24, the wheels 60,62 securely connected to their axles and the axles mounted for rotation with respect to the base 24, or the wheels 60,62 may be mounted for rotation with respect to their axles and the axles mounted for rotation with respect to the base 24. In any such arrangement, the wheels 60,62 are permitted to rotate with respect to the base 24, permitting a user to roll the platform 22 over a variety of surfaces.

It is preferred that the wheels 60,62 are mounted so that when the bottom 34 of the platform 22 is resting on a surface, the wheels 60,62 do not engage the surface or do not raise the platform 22 substantially off of the surface. This configuration aids in maintaining the platform 22 in a fixed position when in use. As illustrated, this configuration is achieved by positioning the wheels 60,62 substantially in the wall 36 and not the base. By having the wheels 60,62 protrude from the wall 36, a user may still roll the platform 22 by raising one end (at wall 38) upwardly so that the wheels 60,62 rotate into engagement with a surface.

The wheels 60,62 may be constructed from a wide variety of materials, such as plastic, rubber, steel or the like. The size of the wheels 60,62 may vary. Preferably, the wheels are relatively small so as to not increase the size or weight of the platform 22 unduly. In one or more embodiments, the wheels 60,62 have a diameter of approximately 1.25 inches and a width of approximately 0.75 inches.

In one or more embodiments, at least one handle is provided to aid a user in transporting the exercise device 20. As illustrated, two handles are provided. A first handle 68 is provided in the third wall 40 (i.e. the wall opposite the wall 42 to which the lid 26 is hinged). The first handle 68 comprises a generally oval cut-out or cut-away section of the third wall 40.

A second handle 70 is preferably provided opposite the side or wall with which the wheels 60,62 are associated. In the arrangement illustrated, since the wheels 60,62 are associated with the first wall 36, the second handle 70 is provided on the second, opposing wall 38. The second handle 70 comprises a generally oval cut-out or cut-away section of the second wall 38.

Those of skill in the art will appreciate that the handles 68,70 may take other forms. For example, each handle 68,70 may comprise an element which extends outwardly from the base 24. The handles 68,70 may be formed integrally with the base 24 or be connected thereto. Each handle 68,70 may comprise an element which is extendable from the base 24, such as in the case of a pop-out or flip-out handle. A handle may be provided on as few as one of the sides or walls of the base 24, or on all of them, and not just the two illustrated and described above.

The platform 22 includes at least one attachment point or mount for an exercise accessory. As illustrated, the platform 22 includes a plurality of such attachments points. Each attachment point preferably comprises a pin 72. Each pin 72 spans a slot 74 which extends downwardly from a top surface of a particular wall 36,38,40,42 of the base 24. As illustrated, one attachment point is provided approximately midway along the first wall 36 between the third and fourth walls 42,44. One attachment point is provided approximately midway along the second wall 38 between the third and fourth walls 42,44. Three attachment points are generally equidistantly provided along the third and fourth walls 42,44.

Each slot 74 generally comprises a rectangular cut-out of the respective wall 36,38,40,42, extending downwardly into the wall from a top surface thereof. A pin 72 extends or spans each slot 74 in a direction parallel to the wall 36,38,40,42. The pins 72 may comprise a wide variety of elements. In one or more embodiments, each pin 72 comprises a metal rod. The pins 72 may be constructed from wood, plastic or other durable and strong materials.

To facilitate easy access to the pins 72 and to permit use of a resistive or other element connected thereto (as described in more detail below), a slot 76 is provided in the lid 26 corresponding to each slot 74 in the walls of the base 24. As illustrated, each slot 76 preferably comprises a recessed or cut-away area of the lid 26.

The number and location of the mounts may vary from those illustrated. In addition, other mounts may be provided, such as mounts on the lid 26 or other portions of the base 24. The manner of connection of the resistive element(s) 28 may be accomplished with other means than pins 72, such as hooks, eyes and other elements.

To facilitate additional accessories, as described in more detail below, first and second passages 78,80 are provided through the base 24. As illustrated, the passages 78,80 are positioned in opposing walls of the base 24. Preferably, the passages 78,80 are aligned along a common axis and positioned in the third and fourth 40,42 walls. Each passage 78,80 comprises a generally circular bore provided through its respective wall 40,42.

The passages 78,80 may be located in other areas in the base 24. In addition, more than one set of passages may be provided.

In accordance with the present invention, the exercise apparatus 20 comprises one or more accessories in addition to the platform 22. Referring to FIG. 2, the exercise apparatus 20 comprises one or more risers 32. As illustrated, there are two risers 32. Each riser 32 comprises a generally square, box-shaped support. In one or more embodiments, each riser 32 is generally hollow (see FIG. 3), having a top surface 82 and a perimeter wall 84 extending downwardly therefrom. Preferably, the top surface 82 of each riser 32 is generally planar for accepting the bottom 34 of the platform 22.

Referring to FIG. 3, in one or more embodiments, the bottom of the bottom surface 34 of the base 24 has a pair of inset or recessed areas sized to accept the risers 32. In this fashion, when the platform 22 is placed on the risers 32 an interlocking effect is achieved and it is less likely that the base 24 will move off of the risers 32 (such as in a sliding motion). In one or more embodiments, the recessed areas are inset into the bottom surface 34 by approximately 0.5 inches.

Preferably, the risers 32 are sized (considering their height, width and length) so that they both may be conveniently stored in the hollow interior 44 of the platform 22 when the lid 26 is closed. In one or more embodiments, each riser 32 is about 4 inches high, and has a width of about 10.5 inches (in use parallel to walls 40,42) and a depth of about 8.5 inches (in use parallel to walls 36,38).

It is noted that a single riser 32 or multiple risers may be provided instead of the two risers 32 described and illustrated. For example, a single large riser 32 may be used. Several risers 32 may be arranged to "nest" within one another when stored, and be arranged to stack when in use. The risers 32 may have a variety of configurations other than square.

In one or more embodiments, a variety of other means may be used to selectively raise and lower the platform 22. Preferably, however, such means does not contribute to an increase in the size of the platform 22 when the means is not in use. In other words, as with the risers 32, it is preferred that the means fit within or not increase the size of the platform 22 as designed for its normal exercise use. The means may comprise one or more feet or legs which extend, fold or rotate out of the platform 22. The means may comprise a platform or box which is nearly the same size as the base 24 and which when placed upside-down therein (open size up) reduces the size of the interior 44 by only the width of the peripheral wall forming the box.

In one or more embodiments, the exercise apparatus 20 includes at least one hand/foot peg 30. Preferably, the exercise apparatus 20 includes two pegs 30. As illustrated, each peg 30 comprises a rod-shaped element. A first portion 86 of each peg 30 preferably has a smaller exterior dimension (in this case, diameter) than a second portion 88. The first portion 86 is sized to fit within one of the passages 80 formed in the platform 22. The increased size of the second portion 88 serves as a stop to prevent over-insertion of the peg 30 into its respective passage 78,80.

The pegs 30 may be constructed from a wide variety of materials such as wood or plastic. In one or more embodiments, each peg 30 is about 9 inches long, with the first portion 86 being about 3 inches long. In an embodiment where the platform 22 includes multiple passages, additional foot/hand pegs 30 may be provided.

Preferably, a sleeve 90 is provided in association with the pegs 30. As illustrated, the sleeve 90 is a tubular element having a hollow interior. The sleeve 90 has an outer diameter sized to permit insertion of the sleeve 90 into the passages 80. The sleeve 90 has a length such that it will span the interior 44 of the platform 22 from passage to passage 80. Preferably, each peg 30 is inserted both through the passage 80 and into the sleeve 90.

In one or more embodiments, a detent (not shown) may be formed near each end of the sleeve 90 for acceptance of a projection (not shown) provided on each peg 30. Such a projection preferably is small enough not to prevent insertion of the peg 30 into the sleeve 90, but is arranged to engage one of the detents, providing some locking effect and an indication to the user of the proper engagement of the peg 30 with the sleeve 90, and securing the peg 30 in place (such as during exercise) except against a high withdrawal force.

The foot/hand pegs 30 may be arranged in a wide variety of other fashions. For example, the pegs may comprise members which fold/swivel outwardly from the base 24. The pegs 30 also need not be round, especially the first portion 86. For example, the first portion 86 of each peg 30 may be triangular or square. In such event, the corresponding passage 78,80 is preferably also similarly shaped. Such a peg 30 may be used when it is desired to prevent the rotation of the peg with respect to the passage. A single elongate peg 30 may be provided and arranged to extend entirely through the base 24.

In one or more embodiments, the exercise apparatus 20 includes at least one resistive element 28. Preferably, the resistive element 28 comprises an elastic, rubber or similar element which may be stretched or extended, and when stretched or extended, generates a biasing force. The resistive element 28 may include multiple strands or bands associated with one another as well. Such elements are well known in the art of exercise equipment.

Preferably, a handle 92 is located at a first end of the resistive element 28. As illustrated, the handle 92 has a gripping portion 94 and a connecting portion 96, the connecting portion 96 connected to the elastic band or other element forming the resistive portion of the element 28.

Means are provided for attaching the resistive element 28 to the platform 22. In one or more embodiment, this means comprises a hook 98 positioned at the end of the resistive element 28 opposite the handle 92. The hook 98 is adapted to receive one of the pins 72 of the platform 22. In one embodiment, the hook 98 includes a hook portion 100 and a latch member 102. The hook portion 100 is generally "J"-shaped. The latch member 102 is attached at one end to a top portion of the hook portion 100. A second end of the latch member 102 is permitted to freely move with respect to the hook portion 100, but biased into a position such that the latch member 102, along with the hook portion 100, forms a generally closed element. In this arrangement, the latch member 102 may be deflected inwardly to permit passage of the hook 98 over the pin 72, but will generally not deflect the opposite direction, retaining the lock 98 securely connected to the pin 72.

In one or more embodiments, a similar hook 99 is provided at an opposing end of the restive element 28 for selective connection to the handle 96 and other accessories such as an exercise bar 104. Of course, the position of the resistive element 28 may be reversed, as the hooks 98,99 at either end of the resistive element 28 may be connected to either the platform 22 or an accessory.

As illustrated, the exercise bar 104 comprises an elongate rod or similar item. In one or more embodiments, the bar 104 has a central core 106 made of steel, plastic or a similar strong and durable material. The bar 104 includes a pad 108 comprising a coating or sleeve over all or a portion of the core 106. In one or more embodiments, a ring 110 or similar element for connection of one of the hooks 98,104 is located at each end of the bar. The bar 104 may have a variety of lengths and configurations. For example, the bar 104 need not be straight, but may include one or more bends as is known in "curl"-bars. Preferably, the bar 104 has a length which permits it to be stored within the interior 44 of the platform 22, such as slightly less than about 3 feet long.

One or more embodiments of the invention comprise a method of using the exercise apparatus 20 of the present invention. A user may store a variety of items in the interior 44 of the platform 22 for storage. These items include the "accessories" described above (resistive elements 28, pegs 30, risers 32, bar 104), and other items such as exercise clothing, towels and the like. These items may be securely stored by latching the latches 48, securing the lid 26 to the base 24 and enclosing them in the interior 44 of the platform 22.

When the lid 26 is closed, a user may conveniently transport the exercise apparatus 20. First, a user may roll the apparatus 20 over a surface. A user may pull the apparatus 20 by gripping the handle 70 at the end of the base 24 opposite the wheels 60,62 and rolling the apparatus 20 on the wheels 60,62.

A user may transport the exercise apparatus 20 by carrying it as well. The user may grip either handle 68,70 to lift and carry the apparatus 20.

When at a particular location, the user may use the exercise apparatus 20 in a variety of manners, as described in detail below. In general, the user may remove the accessories from the platform 22 for use therewith. The user unlatches the latches 48 to release the lid 26, and then rotates the lid to an open position to access the interior portion 44.

The user may insert each peg 30 into a respective one of the passages 78,80. The user presses the smaller first portion 86 of each peg 30 into its respective passage 78,80 and a portion of the sleeve 90. The peg 30 is securely inserted when the larger, second portion 88 of the peg 30 abuts the base 24.

A user may connect the resistive element(s) 28 to the platform 22. The user presses the hook 98 into engagement with one of the pins 72.

If the user desires to raise the level of the platform 22, the user may remove the risers 32 and place them under the platform 22. When the base 24 includes recessed areas therein, the base 24 is aligned with the risers 32 so as to engage the risers 32.

When exercising, it is desirable for the user to re-latch the lid 26 to the base 24. This prevents the lid 26 from opening during use of the apparatus 20.

Of course, when the user has completed exercising, the user may re-stow all of the accessories and other items in the interior 44 of the platform 22 for storage and/or transport.

One or more embodiments of the invention comprise a method of exercising using the exercise apparatus 20 of the present invention. First, a user may use the platform 22 as a step in a step exercise. In this type of exercise, the user steps up and down onto and off of the platform 22. Such exercises are well known.

In order to increase the difficulty of the exercise, the height of the platform 22 may be raised. A user may remove the risers 32 from the interior 44 of the platform 22 and place the platform 22 on the risers. This raises the top surface 56 of the lid 26 farther above the surrounding surfaces.

A user may perform a variety of exercises on the platform 22. For example, a user may rest their back upon the pad 54 on the platform 22 and perform sit-ups, crunches or similar exercises. A user may also rest their back on a surrounding surface and rest their feet/legs upon the raised platform 22 when performing similar exercises.

The user may perform a wide variety of exercises with one or more resistive elements 28, which generate an exercise biasing or resistive force when stretched. The resistive elements 28 may be connected to the platform 22 in a variety of positions and in a variety of combined configurations to accommodate most common exercises. Such exercises include shoulder presses (pressing the arms overhead while gripping the resistive elements), lateral raises (extending the arms from a down to horizontally extending position while gripping the resistive elements), leg lunges (lunging on an off the platform while gripping the resistive elements), calf extensions (raising and lowering the body at the toes while gripping the resistive elements), curls (curling the arms while gripping the resistive elements), tricep extensions (extending the arms while gripping the resistive elements), adduct and abduct leg exercises (extending a leg outwardly or across the other leg with the resistive element connected thereto).

A user may perform exercises with the resistive elements 28 coupled to each end of the bar 104 and the platform 22. Such exercises include squats and presses.

Of course, a variety of exercises may be performed with only one resistive element 28. For example, a user may perform a single arm bicep curl with just one resistive element 28 (as opposed to exercising both arms at the same time). In addition, in some exercises, multiple resistive elements 28 may be used together. For example, a user may perform a single arm bicep curl with two or more resistive elements.

In one or more embodiments, a user may engage in exercises including use of the foot/hand pegs 30. A user may perform a rowing exercise by sitting on the platform 22, placing their feet on the pegs 30 gripping and extending the resistive elements 28 in a rearward direction. A user may perform hamstring exercises by laying stomach-down on the platform 22, gripping the pegs 30 with the hands, hooking the resistive elements 28 to the feet and extending the elements 28 by flexing the leg at the knee. A user may perform leg kick-backs by placing on knee on the platform 22 and gripping the pegs 30 with the hands while retracting and extending the other leg.

The exercise apparatus 20 of the present invention has numerous advantages over the prior art. One advantage of the exercise apparatus 20 is that, despite its compactness and portability, the exercise apparatus 20 permits a user to engage in a wide variety of exercises.

It is noted that the arrangement and location of the mounts has a number of advantages. When a resistive element 28 is connected to a mount, it may be extended outwardly generally horizontally from the platform 22. On the other hand, the resistive element 28 may also be extended generally vertically above the lid 26. The aligned slot 76 in the lid 26 permits this orientation. At the same time, the resistive element 28 is securely connected to a portion of the sturdy and nonmoving base 24.

The slots 76 in the lid 26 also provide an aligning and position maintaining function. When a resistive element 28 is connected to a mount and extends through the slot 76, the resistive element 28 is maintained in a fixed position and not permitted to move along the length (either along a side or end) platform 22. This is a benefit to the user, who when exercising can focus upon the exercise and not upon maintaining the equipment in fixed position to accomplish the exercise.

The location of the mounts along the walls 36,38,40,42 of the base 24 also permits maximum separation of the resistive elements 28 when connected thereto (such as when connected at opposing ends or sides of the platform 22) for exercises when a wide separation is desired, such as extended arm raises and the like. Thus, the platform 22 can be made smaller than when if the attachment points were provided in other configurations, such as on the lid 26.

The exercise apparatus 20 is particularly portable. It is relatively small, and includes handles and wheels for transport. Accessories and other equipment may be conveniently stored within the apparatus 20. The exercise apparatus 20 can be easily moved around for use and storage at home or in the office (such as when used in a room and stored in a closet). The exercise apparatus 20 can be placed in a car or transported as baggage on a plane/train when traveling.

The exercise apparatus 20 is compact. The exercise apparatus 20 does not take up a large amount of space, which is desirable for home and office use. The apparatus 20 may be stored in an upright (i.e. on end/wall 36/38), in which case its "footprint" is very small.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. An exercise apparatus comprising:

an exercise platform comprising a base and a lid, said platform defining an interior space accessible by moving said lid from a closed to an open position with respect to said base;

at least one handle formed in said platform for use by a user in moving said exercise apparatus;

at least one wheel movably mounted to said base and permitting said platform to be rolled along a surface, said at least one wheel located at least partially in a recessed portion of said base;

at least one riser for use in supporting said platform upon a surface to increase a height thereof, said at least one riser sized to fit within said interior space when not in use, said base of said platform having at least one recessed area for accepting a portion of said at least one riser when said platform is placed there on;

at least one resistive element for selective attachment to said platform for use in an exercise by a user;

a first pair of mounts located at opposing sides of said platform to which said at least one resistive element may be attached, and a second pair of mounts located at opposing ends of said platform to which said at least one resistive element may be attached; and at least one hand/foot peg for insertion into an aperture formed in said platform, said hand/foot peg extending outwardly from said platform generally perpendicular thereto when inserted into said aperture.

2. The exercise apparatus in accordance with claim 1 wherein said lid is rotatably mounted to said base.

3. The exercise apparatus in accordance with claim 1 wherein said at least one mount comprises a pin spanning a slot in an upwardly extending wall of said base.

4. The exercise apparatus in accordance with claim 3 including a slot in said lid aligned with said slot in said base when said lid is in a closed position.

5. The exercise apparatus in accordance with claim 3 wherein said resistive element includes a hook element for connection to said pin.

6. The exercise apparatus in accordance with claim 1 including first and second passages located in opposing sides of said platform and a first peg selectively connectable to said platform by insertion into one of said apparatus and a second peg selectively connectable to said platform by insertion into the other of said apertures.

7. The exercise apparatus in accordance with claim 1 wherein said at least one handle comprises a cut-out portion of said base.

8. The exercise apparatus in accordance with claim 1 including a pad positioned on a top portion of said lid.

9. An exercise apparatus comprising:

a platform comprising a base and a lid, said base having a bottom and four upwardly extending walls, said lid movably mounted to said base, said lid moveable between a first closed position and a second open position, said lid in said closed position cooperating with said base to define an enclosed interior area of said platform;

at least one mount associated with said base of said platform, said mount permitting attachment of an exercise element;

passages through a pair of said walls, said passages aligned along a common axis;

a sleeve extending through said interior area between said passages; and a first riser and a second riser, said first and second risers having top and a bottom, said top and bottom spaced from one another and said top having a perimeter, said bottom of said base of said platform having a bottom surface having a first recess and a second recess therein, said first and second recesses having a perimeter of a similar size and shape to said perimeter of said top of said risers, said first and second recesses accepting a portion of said first and second riser permitting a height of said platform to be raised when placed thereon, said first and second risers sized to fit within said interior area.

10. The exercise apparatus in accordance with claim 9 including at least one wheel rotatably mounted with respect to said base at a first wall and at least one handle associated with said platform at a second wall opposite said first wall.

11. The exercise apparatus in accordance with claim 9 wherein said mount comprises a member spanning a slot in at least one of said walls of said base.

12. The exercise apparatus in accordance with claim 9 wherein said first and second risers have a generally square top perimeter and said first and second recesses are generally square in perimeter shape.

13. The exercise apparatus in accordance with claim 9 wherein said first and second recesses are located at opposing ends of said base.

14. An exercise apparatus comprising:

a platform having at least one upwardly extending wall and a top exercise surface, said platform having first and second opposing sides and first and second opposing ends;

a first exercise element mount located at said first side and an opposing second exercise element mount located at said second side of said platform;

a third exercise element mount located at said first side and opposing forth exercise element mount located at said second side of said platform, said first and second and said third and forth exercise element mounts spaced from one another; and a fifth exercise element mount located at said first end and an apposing sixth exercise element mount located at said second end of said platform.

15. The exercise apparatus in accordance with claim 14 wherein said top surface comprises a lid which is movable with respect to said platform.

16. The exercise apparatus in accordance with claim 14 wherein each exercise element mount comprises a pin extending across a slot in said wall of said platform.

17. The exercise apparatus in accordance with claim 14 wherein said slot is located a top portion of said wall.

18. The exercise apparatus in accordance with claim 17 including a seventh exercise element mount located at said first side and a opposing eighth exercise element mount located at said second side of said platform.

19. The exercise apparatus in accordance with claim 9 including at least one hand/foot peg having a first portion located in said sleeve and a second portion extending outwardly of said sleeve and said platform.

* * * * *